United States Patent [19]

Yamamoto et al.

[11] Patent Number: 4,792,544

[45] Date of Patent: Dec. 20, 1988

[54] HEAT SENSITIVE RECORDING MATERIAL

[75] Inventors: Nobuyuki Yamamoto, Toyonaka; Isamu Nishikawa, Ibaraki; Osamu Honmura, Hirakata, all of Japan

[73] Assignee: Nippon Gohsei Kagaku Kogyo Kaboshiki Kaisha, Osaka, Japan

[21] Appl. No.: 42,837

[22] Filed: Apr. 27, 1987

[30] Foreign Application Priority Data

May 9, 1986 [JP] Japan ..... 61-107497

[51] Int. Cl.[4] ..... B41M 5/18

[52] U.S. Cl. ..... 503/216; 427/150; 428/913; 503/217; 503/225

[58] Field of Search ..... 427/150–152; 503/216, 225, 217; 428/913

[56] References Cited

U.S. PATENT DOCUMENTS

| | | | |
|---|---|---|---|
| 4,502,066 | 2/1985 | Satake et al. | 427/150 |
| 4,590,499 | 5/1986 | Fujimura et al. | 427/150 |

FOREIGN PATENT DOCUMENTS

| | | | |
|---|---|---|---|
| 0079793 | 5/1984 | Japan | 503/216 |
| 0127190 | 7/1985 | Japan | 503/216 |
| 2033678 | 2/1987 | Japan | 503/225 |

*Primary Examiner*—Bruce H. Hess

*Attorney, Agent, or Firm*—Antonelli, Terry & Wands

[57] ABSTRACT

A heat sensitive recording material comprising (A) a color forming substance, (B) a developer capable of bringing the color forming substance into color image by heating and (C) a binder, characterized in that the component (B) comprises at least one diphenyl compound having the formula (I):

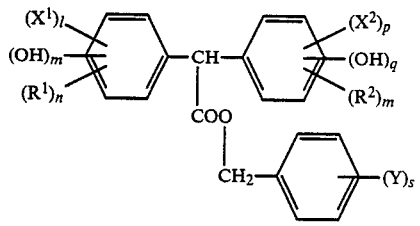

(I)

The heat sensitive recording material can give satisfactory color sensibility, color density and printability in recording process at low temperature and high speed compared to conventional heat sensitive recording materials. Further, there are wholly observed the black fog on the surface of recording paper before recording and the black spot in contact with diazo photosensitive papers.

3 Claims, No Drawings

HEAT SENSITIVE RECORDING MATERIAL

BACKGROUND OF THE INVENTION

The present invention relates to a material suitable for heat sensitive recording papers, and more particularly to a heat sensitive recording material characterized by containing a specific developer capable of bringing a color forming substance into color images by heating.

The heat sensitive recording paper is a recording material in which a heat sensitive layer which can be developed a color by heating is applied to a surface of a substrate such a paper. The recording process is conducted by using a printer such as a thermal printer. The paper is widely utilized in the field of computers, facsimile telegraphs, calculating machines, and the like.

The heat sensitive layer is composed of a composition containing a color forming substance, a developer capable of bringing the color forming substance into color images and a binder, and it is said that the developer is the most influential component to properties of the heat sensitive recording material among the above three components. Accordingly the utility of the heat sensitive recording materials depends on the properties of the used developer.

Bisphenol A has been most numerously used as the developer which brings a colorless dye of electron donor such as Crystal Violet lactone into color images. However, recently, the bisphenol A developers have not been coping with the high speed of printing process, and bis(hydroxyphenyl)acetic acid developers are paid attention instead of the above bisphenol A developers as shown in Japanese Unexamined Patent Publication No. 5288/1983 or Japanese Unexamined Patent Publication No. 79793/1984, and the like.

The heat sensitive recording material containing the bis(hydroxyphenyl)acetic acid developers are excellent in not only the smoothness of recording paper but also the printability at recording process of high speed compared to the material using bisphenol A developers, and accordingly, the desirable results can be obtained from the point of the resolution. However, the thermal printers are improved day after day in order to attain more excellent functions such as heat energy is further economized. Accordingly, it is required to further improve the properties of the heat sensitive recording material, particularly the developer in order to fit the improved functions of the printers. That is, it is required to obtain the developer which can give satisfactory color sensitibity, color density and the excellent resolution at recording process of lower temperature for a short time.

Also, in the known heat sensitive recording materials, a part of the color forming substance is apt to color-develop before printing and accordingly there is observed the black fog on the surface of recording papers which should be white originally, or the recording papers are remarkably blackened by contacting with the diazo photosensitive papers to disappear the printed images.

It is an object of the present invention to provide a heat sensitive recording material free from the above-mentioned defects.

This and other objects of the present invention will become apparent from the description hereafter.

SUMMARY OF THE INVENTION

In accordance with the present invention, there is provided a heat sensitive recording material comprising (A) a color forming substance, (B) a developer capable of bringing the color forming substance into color images by heating and (C) a binder, characterized in that the component (B) comprises at least one diphenyl compound having the formula (I):

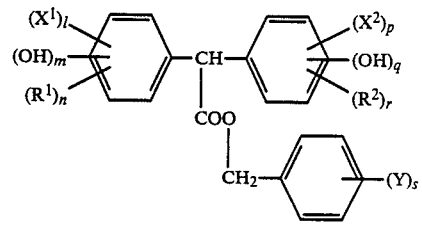

(I)

wherein $X^1$ and $X^2$ are same or different and each is a halogen, $R^1$ and $R^2$ are same or different and each is an alkyl group, Y is a halogen or an alkyl group, each of l and n is 0 or an integer of 1 to 4, m is an integer of 1 to 5, the sum of l, m and n is from 1 to 5, each of p, q and r is 0 or an integer of 1 to 5, the sum of p, q and r is from 0 to 5, and s is 0 or an integer of 1 to 5.

DETAILED DESCRIPTION

In the present invention, the use of the diphenyl compound having the formula (I) as the developer (B) in the material can give improved printability at recording process of high speed. The excellent property can not be expected in the case of the known bis(hydroxyphenyl)acetic acid alkyl ester developers.

As aforementioned, the diphenyl compound used in the present invention as the developer (B) is represented by the formula (I):

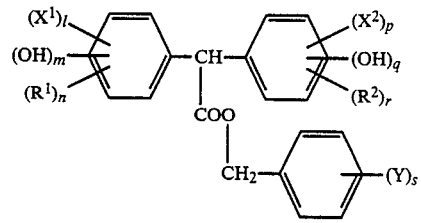

(I)

wherein $X^1$ and $X^2$ are same or different and each is a halogen, $R^1$ and $R^2$ are same or different and each is an alkyl group, Y is a halogen or an alkyl group, each of l and n is 0 or an integer of 1 to 4, m is an integer of 1 to 5, the sum of l, m and n is from 1 to 5, each of p, q and r is 0 or an integer of 1 to 5, the sum of p, q and r is from 0 to 5, s is 0 or an integer of 1 to 5.

In the formula (I), examples of the halogen $X^1$ and $X^2$ are, for instance, bromine, chlorine, and the like, and chlorine is the most preferable from the points of the properties of the heat sensitive recording material and price. Examples of the alkyl groups ($R^1$ and $R^2$) are, for instance, methyl group, ethyl group, propyl group, butyl group, amyl group, and the like, and an alkyl group having 1 to 10 carbon atoms is usually used. Phenyl ring of benzyl group may have a substituent such as a halogen or an alkyl group. When each of l, m, n, p and q is not less than 2, $X^1$ groups, $X^2$ groups, $R^1$ groups or $R^2$ groups may be same or different. For instance, when l is 2, the formula (I) can have not only a single kind of the halogen atom but also different kinds of the halogen atoms such as chlorine and bromine as the groups $X^1$.

The typical examples of the diphenyl compound (I) are as follows:

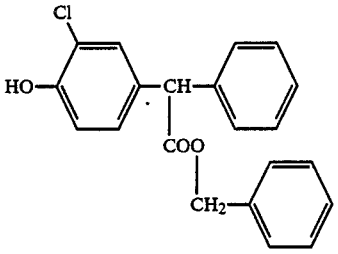

Benzyl 3-chloro-4-hydroxy-α-phenyl-phenylacetate

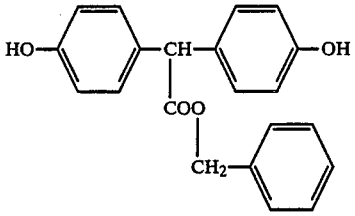

Benzyl bis(4-hydroxyphenyl)-acetate

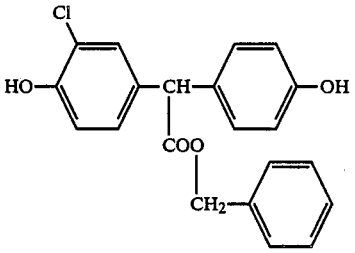

Benzyl 3-chloro-4-hydroxy-α-(4-hydroxyphenyl)-phenylacetate

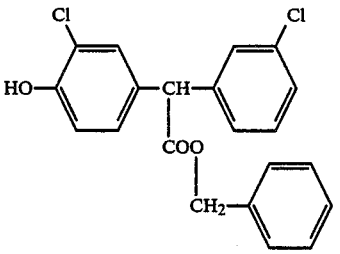

Benzyl 3-chloro-4-hydroxy-α-(3-chlorophenyl)-phenylacetate

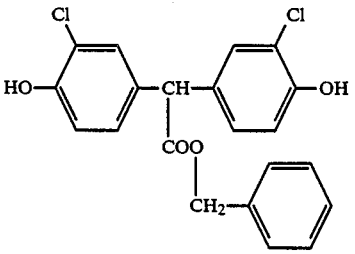

Benzyl bis(3-chloro-4-hydroxy-phenyl)acetate

-continued

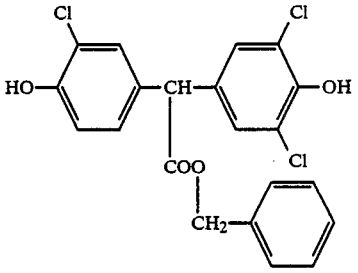

Benzyl 3-(chloro-4-hydroxy-α-(3,5-di-chloro-4-hydroxy-phenyl)phenyl-acetate

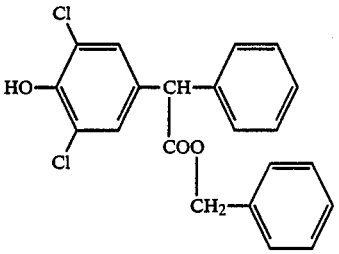

Benzyl 3,5-di-chloro-4-hydroxy-α-phenyl-phenyl-acetate

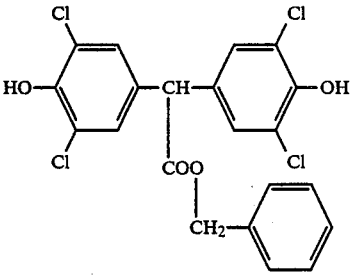

Benzyl bis(3,5-di-chloro-4-hydroxy-phenyl)acetate

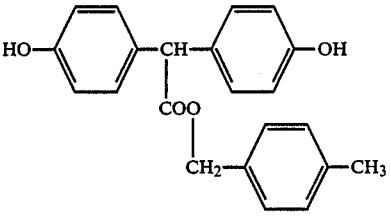

4-Methylbenzyl bis(4-hydroxy-phenyl)acetate

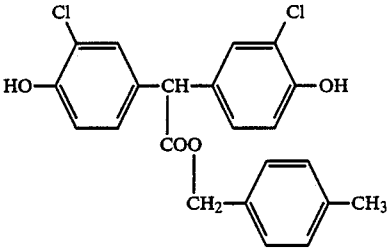

4-Methylbenzyl bis(3-chloro-4-hydroxyphenyl)-acetate

The diphenyl compounds (I) are not limited thereto, and they may be used alone or in admixture thereof.

In the present invention, as the developer (B), there can be used a blend of the above diphenyl compound (I) with a known developer such as bisphenol A, an alkyl ester of bis(hydroxyphenyl)acetic acid or a bisphenol-sulfide compound. Examples of the known developers are, for instance, 4,4'-isopropylidene diphenol, 4,4'-isopropylidene bis(2-chlorophenol), 4,4'-isopropylidene bis(2-t-butylphenol), 4,4'-sec-butylidene diphenol, 4,4'-(1-methyl-n-hexylidene)diphenol, 4,4'-cyclohexylidene diphenol, 4,4'-thiobis(6-t-butyl-3-methylphenol), and the like.

As the color forming substance (A), there are used a compound having a lactone ring, a compound having lactam ring, a compound having sultone ring or a compound having spiropyran ring, which are capable of reacting with the developer (B) by heating to bring into a color image, such as a triphenyl methane compound, a triphenylmethanephthalide compound, a fluoran compound, a leuco-Auramine compound, or a spiropyrane compound. Typical examples of the color forming substance (A) are, for instance, Crystal Violet lactone, Malachite Green lactone, 3,3-bis-(p-dimethylaminophenyl)-6-aminophthalide, 3,3-bis(p-dimethylaminophenyl)-6-(p-toluenesulfoamide)phthalide, 3-diethylamino-7-(N-methylanilino)fluoran, 3-diethylamino-7-(N-methyl-p-toluidino)fluoran, 3-dimethylamino-6-methoxyfluoran, 3-diethylamino-7-chlorofluoran, 3-diethylamino-6-methyl-7-chlorofluoran, 3-diethylamino-7-phenylfluoran, 3-morpholino-5,6-benzofluoran, 3-diethylamino-5-methyl-7-dibenzylaminofluoran, 3-diethylamino-7-dibenzylaminofluoran, 3-diethylamino-7,8-benzofluoran, 3-cyclohexylamino-6-chlorofluoran, N-phenyl Rhodamine B lactam, Acid Rhodamine B sultone, benzo-$\beta$-naphtospiropyrane, 2-methyl-spironaphtopyrane, 1,3,3-trimethyl-6'-chloro-8'-methoxyindolinobenzospiropyrane, and the like, but the color forming substance (A) is not limited thereto. They may be used alone or in admixture thereof.

Examples of the binder (c) are, for instance, polyvinyl alcohol and its derivatives, water-soluble polyesters, carboxymethyl cellulose, methyl cellulose, hydroxyethyl cellulose, copolymers of styrene and maleic acid and their salts, copolymers of isobutyrene and maleic acid and their salts, sodium alginate, modified starch, SBR latex, acrylic lates, gum arabic, terpene resins, cyclized rubbers, and the like, but the binder (C) is not limited thereto.

When the heat sensitive recording material is prepared, it is general that an aqueous dispersion of the color forming substance (A), an aqueous dispersion of the developer (B) and an aqueous solution of the binder (C) are prepared separately and then the dispersions and the solution are mixed to give the composition. A part of the binder (C) may be added to at least one of the dispersion of the color forming substance (A) and the dispersion of the developer (B). It is preferable that the amounts of the color forming substance (A), the developer (B) and the binder (C) are 3 to 30% by weight of component (A), 6 to 60% by weight of component (B) and 4 to 40% by weight of component (C). It is preferable that the solid concentration of the composition is from 10 to 40% by weight from the point of the workability.

To the thus obtained aqueous composition can be added known additives, e.g. agents for giving water resistance such as glyoxal or urea resins, defoaming agents, dispersing agents, surfactants, various wax, amides of fatty acid, metal salts of fatty acid, clay, calcium carbonate, satin white, titanium dioxide, and the like. The composition is applied to the substrate.

The substrates to be applied are not particularly limited and any substrates such as papers, synthetic papers or resin films can be used. When applying the composition to the substrate, any known method such as roll coating method, an air-knife coating method and a blade coating method can be applied. It is preferable that the amount of the coating is from about 0.1 to about 20 g/m$^2$, more preferably from about 3 to about 15 g/m$^2$ on the base of solid.

The heat sensitive recording material of the present invention gives the excellent printabilities such as color sensibility and color density even in the recording process of low temperature and high speed. Further, there are not wholly observed the black fog on the surface of recording papers before recording process and the black spot in contact with diazo photosensitive papers.

The present invention is more specifically described and explained by means of the following Examples in which all percents and parts are by weight unless otherwise noted. It is to be understood that the present invention is not limited to Examples, and various changes and modifications may be made in the invention without departing from the spirit and scope thereof.

EXAMPLE 1

| | |
|---|---|
| Dispersion (A) | |
| Crystal Violet lactone | 7 parts |
| 10% aqueous solution of PVA 10 parts (polyvinyl alcohol commercially available under the commercial name of "GOHSENOL GL-05" made by Nippon Gohsei Kagaku Kogyo Kabushiki Kaisha) | |
| Stearic acid amide | 10 parts |
| Calcium carbonate | 25 parts |
| Water | 60 parts |
| Dispersion (B) | |
| Benzyl bis(3-chloro-4-hydroxyphenyl)acetate having the formula: | 25 parts |

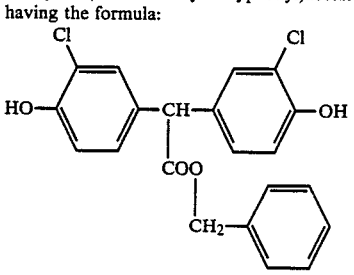

| | |
|---|---|
| 10% aqueous solution of PVA | 10 parts |
| Calcium carbonate | 25 parts |
| Solution (C) | |
| 10% aqueous solution of PVA | 110 parts |

The dispersions (A) and (B) and the solution (C) were prepared separately, each of the dispersions (A) and (B) was pulverized by using a sand grinder until average particle sizes of solid matters were from 2 to 3$\mu$, and the dispersions (A) and (B) and the solution (C) were mixed. The mixture was coated on a paper having a basis weight of 50 g/m$^2$ so that an amount of coating was 10 g/m$^2$ on the base of solid and was dried to give a heat sensitive recording paper.

The physical properties of the obtained heat sensitive recording paper are shown in Table 1.

Color Density

The obtained recording paper is contacted with a metal block having a surface temperature of 100° C. or 110° C. for 2 seconds to develop a color. After 60 minutes, the color density was measured by using a densitometer (commercially available from Macbeth Co., Ltd.).

Smoothness

The smoothness of the obtained recording paper is measured by using a smoothness tester (commercially available from Oji Paper Co., Ltd.) after the paper is allowed to stand at 20° C. under 65% RH.

Brightness by Hanter

The brightness of the obtained recording paper is measured according to JIS P 8123.

Black Fog Due to Diazo Photosensitive Paper

The obtained recording paper is put between diazo photosensitive papers allowed to stand for 5 minutes after the photosensitive papers are passed through a diazo copying machine, which are allowed to stand for 10 minutes, and the recording paper is taken out. After allowing to stand the recording paper for 30 minutes, its color density is measured by using the above-mentioned densitometer. (The color density of the recording paper which is not contained with diazo photosensitive papers is 0.12.)

COMPARATIVE EXAMPLES 1 AND 2

The procedure of Example 1 was repeated except that n-butyl bis(4-hydroxyphenyl)acetate (Comparative Example 1) or bisphenol A (Comparative Example 2) was used instead of benzyl bis(3-chloro-4-hydroxyphenyl)acetate in the dispersion (B). The results are shown in Table 1.

EXAMPLES 2 TO 5

The procedure of Example 1 was repeated except that each of the following diphenyl compounds was used instead of benzyl bis(3-chloro-4-hydroxyphenyl-)acetate in the dispersion (B). The results are shown in Table 1.

THE USED COMPOUND IN EACH OF EXAMPLES 2 TO 5

Example 2

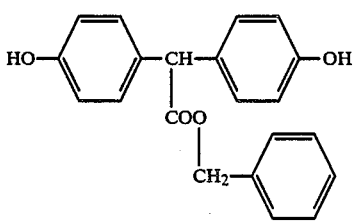

Example 3

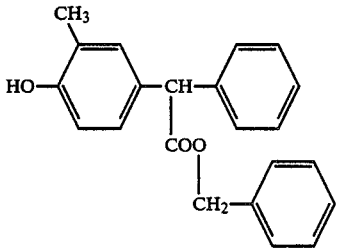

-continued

Example 4

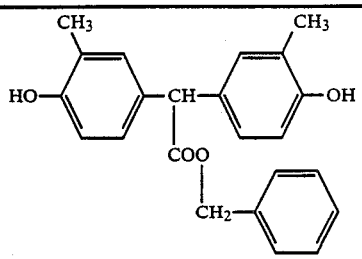

Example 5

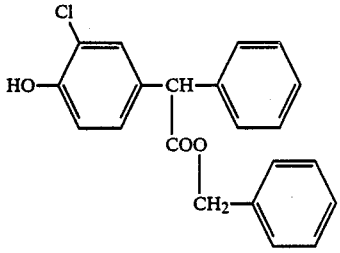

TABLE 1

| Ex. No. | Color density (110° C.) | Color density (110° C.) | Smoothness (sec) | Brightness by Hanter | Black for due to photosensitive paper |
|---|---|---|---|---|---|
| Ex. 1 | 1.24 | 1.26 | 430 | 70 | 0.15 |
| Ex. 2 | 1.24 | 1.26 | 435 | 68 | 0.17 |
| Ex. 3 | 1.25 | 1.25 | 425 | 70 | 0.16 |
| Ex. 4 | 1.25 | 1.26 | 425 | 69 | 0.17 |
| Ex. 5 | 1.25 | 1.26 | 430 | 70 | 0.16 |
| Com. Ex. 1 | 1.20 | 1.26 | 420 | 64 | 0.68 |
| Com. Ex. 2 | 1.10 | 1.15 | 280 | 63 | 0.72 |

What we claim is:

1. A heat sensitive recording material comprising a recording layer on a substrate, said recording layer comprising (A) a color forming substance, (B) a developer capable of bringing the color forming substance into color image by heating, and (C) a binder, characterized in that the component (B) comprises at least one diphenyl compound having the formula (I):

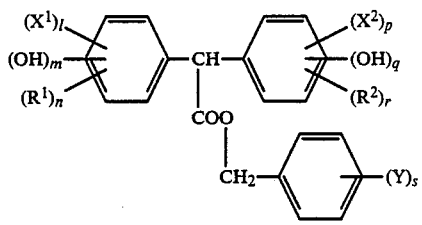

(I)

wherein $X^1$ and $X^2$ are same or different and each is a halogen, $R^1$ and $R^2$ are same or different and each is an alkyl group, Y is a halogen or an alkyl group, each of l and n is 0 or an integer of 1 to 4, m is an integer of 1 to 5, the sum of l, m and n is from 1 to 5, and each of p, q, and r is 0 or an integer of 1 to 5, the sum of p, q, and r is from 0 to 5, and s is 0 or an integer of 1 to 5.

2. The heat sensitive recording material of claim 1, wherein said component (B) is benzyl bis(3-chloro-4-hydroxyphenyl)acetate.

3. The heat sensitive recording material of claim 1, wherein said component (B) is benzyl bis(4-hydroxyphenyl)acetate.

* * * * *